US007797923B2

(12) United States Patent
Naik et al.

(10) Patent No.: US 7,797,923 B2
(45) Date of Patent: Sep. 21, 2010

(54) CONTROL STRATEGY FOR LEAN NOX TRAP REGENERATION

(75) Inventors: Sanjeev M. Naik, Troy, MI (US); David J. Cleary, West Bloomfield, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 129 days.

(21) Appl. No.: 12/132,678

(22) Filed: Jun. 4, 2008

(65) Prior Publication Data

US 2008/0229729 A1 Sep. 25, 2008

Related U.S. Application Data

(63) Continuation of application No. 10/812,467, filed on Mar. 30, 2004, now Pat. No. 7,401,462.

(51) Int. Cl.
*F01N 3/00* (2006.01)

(52) U.S. Cl. ..... 60/274; 60/285; 60/286; 60/295; 123/295

(58) Field of Classification Search ..... 60/274, 60/276, 285, 286, 295, 303; 123/295, 299
See application file for complete search history.

(56) References Cited

U.S. PATENT DOCUMENTS 5,437,153 A * 8/1995 Takeshima et al. ..... 60/276
5,732,554 A 3/1998 Sasaki et al.
5,775,099 A 7/1998 Ito et al.
6,041,592 A 3/2000 Huynh et al.
6,065,443 A 5/2000 Mizuno et al.
6,079,204 A 6/2000 Sun et al.
6,109,025 A 8/2000 Murata et al.
6,148,612 A 11/2000 Yamashita et al.
6,223,525 B1 5/2001 Takanohashi
6,237,329 B1 5/2001 Mizuno
6,244,047 B1 6/2001 Brehob et al.
6,253,546 B1 7/2001 Sun et al.
6,293,092 B1 9/2001 Ament et al.
6,336,320 B1 1/2002 Tanaka et al.
6,370,868 B1 4/2002 Kolmanovsky et al.
6,434,929 B1 8/2002 Nishimura et al.
6,460,328 B1 * 10/2002 Hertzberg ..... 60/285
6,487,851 B1 * 12/2002 Okada et al. ..... 60/285

(Continued)

FOREIGN PATENT DOCUMENTS

DE 19933712 A1 5/2001

(Continued)

*Primary Examiner*—Tu M Nguyen

(57) ABSTRACT

A method for controlling regeneration of a lean NOx trap includes estimating an accumulated NOx in the lean NOx trap; determining whether the estimated NOx exceeds a first threshold value or a second threshold value; estimating the temperature of the lean NOx trap; determining whether the estimated temperature exceeds a threshold temperature; determining a desired air-fuel ratio for initiating a regeneration event, the desired air-fuel ratio being determined based upon the estimated NOx and the estimated temperature of the lean NOx trap; hastening the occurrence of a regeneration event when the estimated NOx exceeds the first threshold value through active control of engine operating regimes; and initiating a regeneration event when the estimated NOx exceeds the second threshold value or when the estimated temperature exceeds the threshold temperature by forcing homogenous operation of the engine at the desired air-fuel ratio.

7 Claims, 7 Drawing Sheets

U.S. PATENT DOCUMENTS

| | | | | |
|---|---|---|---|---|
| 6,539,709 | B2 | 4/2003 | Kubo et al. | |
| 6,553,757 | B1 | 4/2003 | Surnilla et al. | |
| 6,609,364 | B2 | 8/2003 | Litorell et al. | |
| 6,615,579 | B2 * | 9/2003 | Nishiyama | 60/285 |
| 6,620,392 | B2 | 9/2003 | Okamoto et al. | |
| 6,708,668 | B2 | 3/2004 | Yoshida et al. | |
| 6,722,121 | B2 | 4/2004 | Gui et al. | |
| 6,763,657 | B2 * | 7/2004 | Wachi et al. | 60/285 |
| 6,782,694 | B2 | 8/2004 | Nakagawa et al. | |
| 7,251,930 | B2 * | 8/2007 | Audouin | 60/285 |
| 7,530,220 | B2 * | 5/2009 | Miller et al. | 60/274 |
| 7,533,523 | B2 * | 5/2009 | Wang et al. | 60/295 |
| 2002/0029562 | A1 | 3/2002 | Ishii et al. | |

FOREIGN PATENT DOCUMENTS

| | | | |
|---|---|---|---|
| DE | 19963901 | A1 | 7/2001 |

* cited by examiner

CONTROL STRATEGY FOR LEAN NOX TRAP REGENERATION

CROSS REFERENCE TO RELATED APPLICATIONS

This application is a continuation of and claims the benefit of U.S. application Ser. No. 10/812,467 filed on Mar. 30, 2004 which is hereby incorporated herein by reference.

TECHNICAL FIELD

The present disclosure relates to the control of a lean-burn internal combustion engine and more particularly relates to a control strategy for regeneration of a lean NOx trap located in the exhaust path of a spark ignition direct injection engine.

BACKGROUND

It is known in the art relating to internal combustion engines that by operating an engine with a less than stoichiometric (lean) mixture of fuel and air, efficiency of the engine is improved. This means that for a given amount of work performed by the engine, less fuel will be consumed, resulting in improved fuel efficiency. It is also well known that reduction of NOx emissions when the fuel rate is lean has been difficult to achieve, resulting in an almost universal use of stoichiometric operation for exhaust control of automotive engines. By operating an engine with a stoichiometric mixture of fuel and air, fuel efficiency is good and NOx emission levels are reduced by over 90% once the vehicle catalyst reaches operating temperatures.

Recent developments in catalysts and engine control technologies have allowed lean operation of the engine, resulting in improved fuel efficiency and acceptable levels of NOx emissions. One such development is a NOx adsorber (also termed a "lean NOx trap" or "LNT"), which stores NOx emissions during fuel lean operations and allows release of the stored NOx during fuel rich conditions with conventional three-way catalysis to nitrogen and water. The adsorber has limited storage capacity and must be regenerated with a fuel rich reducing "pulse" as it nears capacity. It is desirable to control the efficiency of the regeneration event of the adsorber to provide optimum emission control and minimum fuel consumption. Various strategies have been proposed.

Techniques are known for adsorbing NOx (trapping) when the air-fuel ratio of the exhaust gas flowing into the NOx adsorbent is lean and releasing the adsorbed NOx (regenerating) when the air-fuel ratio of the exhaust gas flowing into the NOx adsorbent becomes rich wherein the amount of NOx adsorbed in the NOx adsorbent may be estimated from the engine load and the engine rotational speed. When the amount of the estimated NOx becomes the maximum NOx adsorption capacity of the NOx adsorbent, the air-fuel ratio of the exhaust gas flowing into the NOx adsorbent is made rich. Determination of a regeneration phase may also be on the basis of individual operating cycles of the internal combustion engine.

It is also known to estimate how full the LNT is by estimating the amount of NOx flowing into the LNT using a pre-LNT oxygen sensor. It is also known to schedule LNT regeneration based on estimations of accumulated NOx mass and engine load and speed operating condition probabilities.

Commonly assigned U.S. Pat. No. 6,293,092 to Ament et al. entitled "NOx adsorber system regeneration fuel control" discloses a method for controlling regeneration fuel supplied to an internal combustion engine operating with a lean fuel-air mixture during sequential rich mixture regeneration events of a NOx adsorber in which NOx emissions collected by the adsorber are purged to provide optimum emissions control and minimum fuel consumption. The method monitors the exhaust gases flowing out of the adsorber during the regeneration event to detect when the fuel-air mixture to the engine is within an excessively lean or rich range. When the sensed exhaust gases contain an excessively lean fuel-air mixture, fuel is increased to the engine. Fuel is decreased when the sensed exhaust gases contain an excessively rich fuel-air mixture. The fuel can be increased or decreased by adjusting the duration or fuel rate of the regeneration event. U.S. Pat. No. 6,293,092 is hereby incorporated by reference.

In the art related to spark ignition direct injection (SIDI) engines, it is known to operate the engine in a stratified charge mode (very lean operation) in a lower range of engine output and in a homogeneous mode (less lean, stoichiometric, or rich of stoichiometric operation) in a higher range of engine power output with an intermediate zone wherein the cylinders operate in a combination of stratified charge and homogeneous charge combustion. Such engine operation may generally be referred to as mixed mode operation. In the stratified charge mode, the fuel is injected during the piston compression stroke, preferably into a piston bowl from which it is directed to a spark plug for ignition near the end of the compression stroke. The combustion chambers contain stratified layers of different air/fuel mixtures. The stratified mode generally includes strata containing a stoichiometric or rich air/fuel mixture nearer the spark plug with lower strata containing progressively leaner air/fuel mixtures. In the homogeneous charge mode, fuel is injected directly into each cylinder during its intake stroke and is allowed to mix with the air charge entering the cylinder to form a homogeneous charge, which is conventionally ignited near the end of the compression stroke. The homogenous mode generally includes an air/fuel mixture that is stoichiometric, lean of stoichiometric or rich of stoichiometric.

Commonly assigned U.S. Pat. No. 7,181,908, the disclosure of which is hereby incorporated by reference herein in its entirety, describes a method to control a direct-injection gasoline engine during LNT regeneration events thereby improving driveability by adapting fueling to account for pumping losses resulting from higher throttling at homogeneous operation. Further, commonly assigned U.S. Pat. No. 7,181,902, the disclosure of which is hereby incorporated by reference herein in its entirety, describes a method to control a direct-injection gasoline engine during LNT regeneration events thereby improving driveability by timing transitions to homogeneous operation in accordance with fuel/air equivalence ratio considerations.

There remains a need in the art for a LNT regeneration control strategy, particularly for mixed mode spark ignition direct injection (SIDI) engines, that enables LNT regeneration without adversely impacting driveability or NOx emissions at the tailpipe.

SUMMARY

The disclosure disclosed herein concerns the coordinated scheduling of lean NOx trap (LNT) regeneration during normal vehicle driving behavior with the scheduling dependant upon the estimated state of the LNT. The disclosure thereby improves NOx emission control without adversely impacting driveability or fuel economy.

In accordance with the present disclosure, a lean NOx trap is positioned in the exhaust gas stream of an internal combustion engine to receive exhaust emissions therefrom. The engine is operable in a homogeneous region and non-homogeneous region (e.g. stratified or mixed mode). During periods of lean engine operation, the NOx adsorber is effective to trap NOx emissions. During periods of rich engine operation (e.g. rich homogeneous charge), the NOx trap releases the trapped NOx thereby regenerating the trap. In accordance with one aspect of the present disclosure, regeneration of the NOx trap is coordinated with normal engine operation. This is accomplished, where practical, by scheduling regeneration during periods wherein the engine is operating in a homogeneous region. The NOx trap NOx accumulation is monitored and when the NOx trap becomes occluded to a certain level, the present disclosure makes it more probable that the engine will operate in a homogeneous region by redefining the homogeneous and non-homogeneous regions, thereby hastening the entry into homogeneous region and enabling regeneration of the NOx trap. In accordance with another aspect of the present disclosure, high temperature of the NOx trap as well as high levels of occlusion may force regeneration regardless of how the homogeneous and non-homogeneous regions are defined. In accordance with another aspect of the present disclosure, the level of occlusion and temperature of the NOx trap may used to define how aggressively the regeneration is implemented. Finally, regeneration may be terminated by such factors as exhaust gas constitution out of the NOx trap, regeneration duration and engine torque demand, whereafter the NOx trap accumulation monitoring is reset to an appropriate level consistent with the completeness of regeneration having been performed.

By tying the LNT regeneration event to the operating state of the vehicle, the present control strategy for lean NOx trap regeneration enables direct-injection gasoline engine powered vehicles to reduce emissions (especially NOx) while maintaining good driveability and minimally impacting the fuel economy benefits of such power trains.

These and other features and advantages of the disclosure will be more fully understood from the following description of certain specific embodiments of the disclosure taken together with the accompanying drawings.

BRIEF DESCRIPTION OF THE DRAWINGS

One or more embodiments will now be described, by way of example, with reference to the accompanying drawings, in which:

FIGS. 4-7 show illustrative vehicle test data that includes a single regeneration event hastened in accordance with the present disclosure due to the accumulated NOx exceeding a first threshold, wherein;

FIG. 4 is a graph illustrating vehicle speed in accordance with the flow of operations of FIG. 2, FIG. 5 is a graph illustrating accumulated lean NOx trap loading and regeneration in accordance with the flow of operations of FIG. 2, FIG. 6 is a graph illustrating desired fuel/air equivalence ratio for initiating a regeneration event in accordance with the flow of operations of FIG. 2, and FIG. 7 is a graph illustrating brake effective mean pressure in accordance with the flow of operations of FIG. 2.

DETAILED DESCRIPTION

Figure 1:
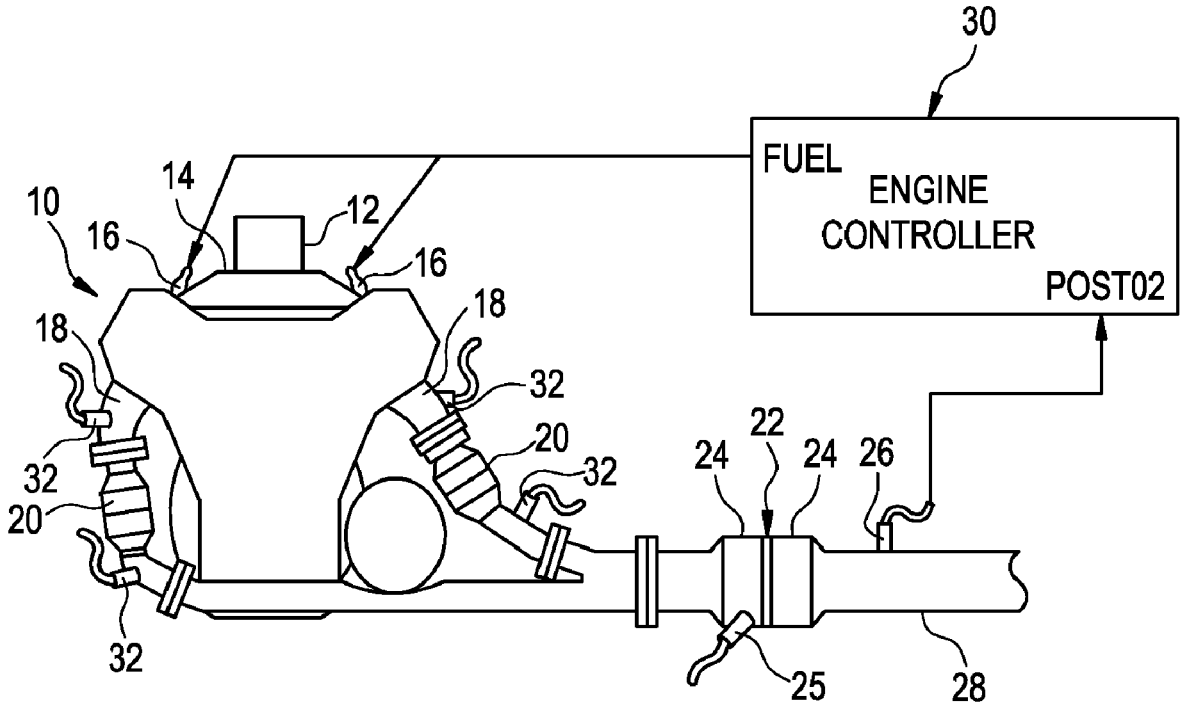
FIG. 1 is a block diagram showing generally a SIDI engine and engine control hardware in accordance with the present disclosure.

Referring now to the drawings, wherein the showings are for the purpose of illustrating certain exemplary embodiments only and not for the purpose of limiting the same, FIG. 1 is a block diagram showing one possible embodiment of a system for carrying out the present disclosure including a spark ignition direct injection engine 10 having an air intake 12 for admitting a flow of air into the engine 10 through intake manifold 14 by control of air throttle valves (not shown). Electronically-controlled fuel injectors 16 are disposed in the engine 10 for metering fuel thereto. The air-fuel mixtures are then burned in engine cylinders (not shown).

Exhaust gases produced in the engine cylinder combustion process flow out of the engine cylinders and through one or more exhaust gas conduits 18. A catalytic device such as a three-way converter 20 is connected to the exhaust gas conduit 18 to treat or clean the exhaust gases. From the catalytic device 20, the exhaust gases pass through a lean NOx trap (LNT) 22 including two elements 24 and, optionally, a temperature sensor 25 (temperature sensor 25 is not required if code is employed to estimate the LNT temperature from various engine operating conditions). An air-fuel ratio sensor 26, such as a post-LNT wide range or a conventional switching-type O2 sensor, is disposed within the tailpipe 28 for monitoring the concentration of available oxygen in the exhaust gases and providing an output voltage signal POSTO2 which is received and analyzed by an engine controller 30. The controller 30 includes ROM, RAM and CPU and includes a software subroutine 200 (described in FIG. 2) for performing the method of the present disclosure. The controller 30 controls fuel injectors 16, which inject fuel into their associated cylinders (not shown) in precise quantities and timing as determined by the control 30. The controller 30 transmits a fuel injector signal to the fuel injectors 16 to maintain an air-fuel ratio determined by the controller including the desired air-fuel ratio in accordance with the present control strategy. Additional sensors (not shown) provide other information about engine performance to the controller 30, such as crankshaft position, angular velocity, throttle and air temperature. Additionally, other oxygen sensors 32 variously placed may provide additional control information. The information from these sensors is used by the controller 30 to control engine operation.

Figure 2:
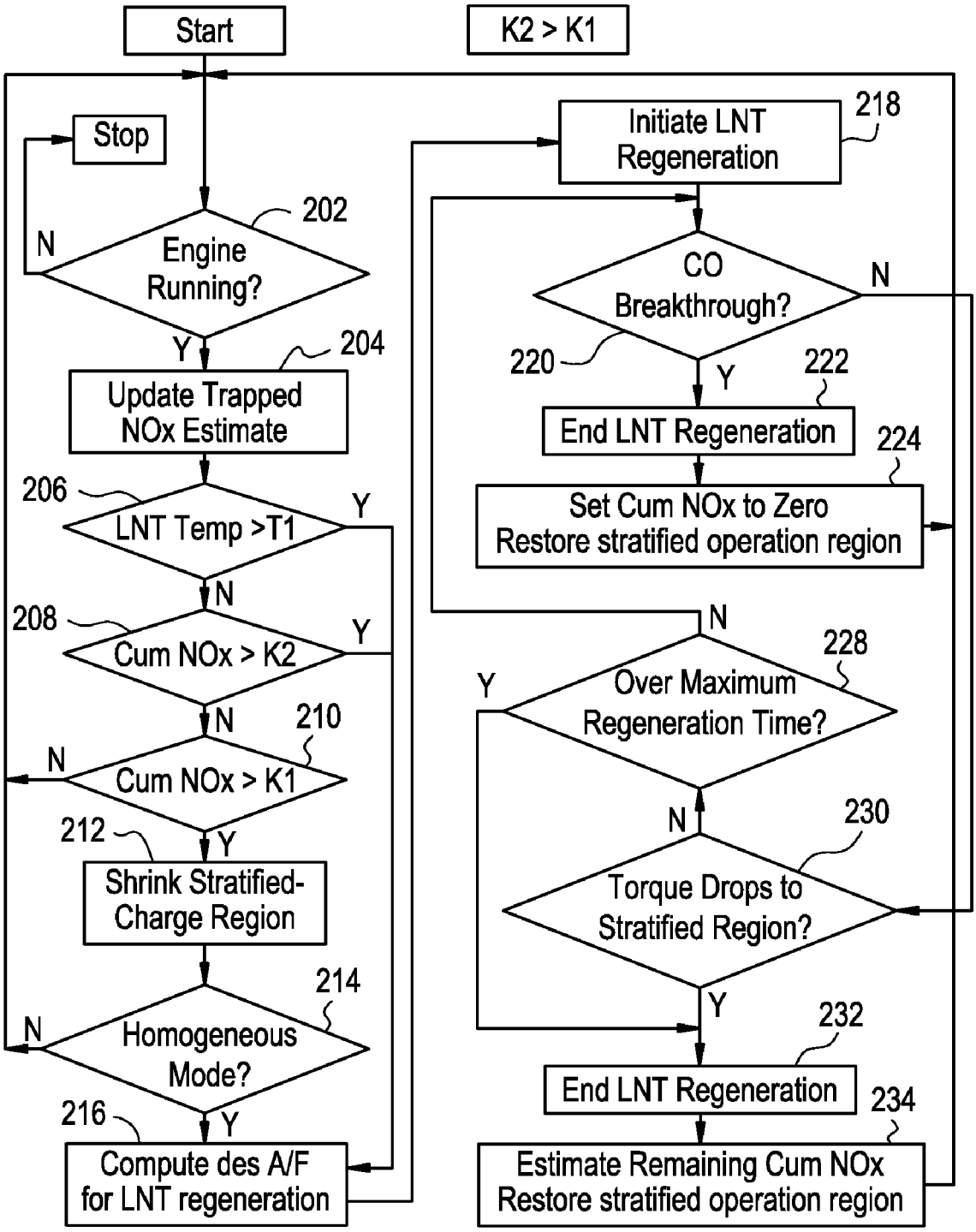
FIG. 2 is a computer flow chart illustrating a flow of operations for carrying out the control strategy for lean NOx trap regeneration in accordance with the present disclosure.

Turning now to FIG. 2, a flowchart of a software subroutine 200 for performing the method of the present disclosure is shown. This subroutine would be entered periodically from the main engine control software located in engine controller 30. At block 202 a determination is made as to whether or not the engine 10 is running. If the engine 10 is not running, the subroutine 200 is exited.

If the engine 10 is running, an estimation of the accumulated NOx in the lean NOx trap 22 is computed as indicated at block 204. At block 206, the temperature of the lean NOx trap 22 is determined. If the temperature of the lean NOx trap 22 exceeds the threshold temperature T1, for example 500° C., then the engine is forced into homogeneous charge operation and a lean NOx trap regeneration event is initiated. If the lean NOx trap temperature is below the threshold temperature T1, the accumulated NOx in the lean NOx trap 22 is compared to a second threshold value K2 at block 208, wherein the value of K2 is greater than the value of K1. For example, K2 may be a second fraction of the lean NOx trap capacity, such as two-thirds. If the estimation of NOx in the lean NOx trap 22 exceeds the second threshold value K2, then the engine is forced into homogeneous charge operation and a lean NOx trap regeneration event is initiated. If the computed accumulated NOx in the lean NOx trap 22 is below the second threshold value K2, the accumulated NOx in the lean NOx trap 22 is compared to the first threshold value K1 in block 210. K1 may be, for example, a first fraction of the lean NOx trap capacity, such as one-third. With the computed accumulated NOx in the lean NOx trap 22 below the first threshold valve K1, then subroutine returns to block 202.

With the computed accumulated NOx in the lean NOx trap 22 above the first threshold value K1, and below the second threshold value K2, the stratified charge operating region is reduced in block 212. This step is further illustrated in FIGS. 3A and 3B. For example, while a typical brake mean effective pressure (BMEP) to transition to homogeneous operation would be 5 bar, the present control strategy decreases the BMEP in a first step to a lower BMEP such as 4 bar. Reduction of the stratified operating region may also take the form of engine speed threshold reductions or combination of both BMEP and engine speed reductions. If the cumulative NOx is greater than the first threshold value K1, then the regeneration event is initiated at the earliest next homogenous operation event.

In block 214, a determination is made as to whether the engine 10 is operating in the extended homogeneous charge region or in the reduced stratified charge region. With the engine operating in the reduced stratified charge operating region, the subroutine returns to block 202. Namely, the computed accumulated NOx in the lean NOx trap 22 is updated in block 204, a determination is made as to whether the temperature of the lean NOx trap 22 is above or below the threshold temperature T1 in block 206 and the stored NOx level is determined above or below the second threshold value K2 in block 208 and/or the first threshold value K1 in block 210. If the cumulative NOx level is greater than the second threshold value K2 or the lean NOx trap temperature exceeds the threshold temperature T1, then the lean NOx trap regeneration event is initiated immediately. Otherwise, control returns to the previous steps at block 202. It is envisioned that successive loops through the previously described steps 202 through 214 may result in incremental reductions of the stratified charge region at block 212 or maintenance of the stratified charge region at the previous reduction.

Referring to block 214, if the engine is not operating in the homogenous charge mode, the regeneration is delayed until the transition from stratified charge mode to homogeneous charge mode is achieved. If the engine is operating in the homogenous charge mode, the desired air-fuel ratio for the particular lean NOx trap regeneration event is computed as indicated at block 216. The air-fuel ratio commanded during the regeneration event may be, but is not necessarily limited to be, a function of the estimated cumulative NOx adsorbed by the lean NOx trap 22. For example, a richer air-fuel ratio is typically commanded as the accumulated NOx level increases, essentially regenerating a more occluded trap more aggressively. The commanded air-fuel ratio during a lean NOx trap regeneration event may also be a function of the lean NOx trap temperature.

The regeneration event is initiated at block 216 when the estimated NOx in the lean NOx trap 22 exceeds the second threshold value K2 by forcing homogenous operation of the engine 10 at the desired air-fuel ratio. The rich air-fuel ratio is achieved by adding fuel to the engine during the regeneration event, while controlling fuel-injection timing, fuel injection strategy, and spark timing to maintain engine torque and provide the necessary reductants to the lean NOx trap 22 for optimal regeneration efficiency. The regeneration event continues until a regeneration ending event is reached. Regeneration ending events include monitored post-LNT exhaust gases showing a rich deviation, regeneration time exceeding a maximum target regeneration time interval, and driver initiated action such as a reduction in driver torque demand below a target value (i.e. low load operation).

The exhaust gases flowing out of the lean NOx trap 22 are monitored as indicated at block 220, such as with post-LNT wide range air-fuel ratio sensor 26. If the exhaust gases flowing out of the lean NOx trap 22 show a sufficiently rich air-fuel ratio, this indicates a regeneration ending event and the regeneration event is ended at block 222. For example, regeneration is ended when the post-lean NOx trap air-fuel ratio sensor 26 shows a rich deviation; that is, the post lean NOx trap fuel-air ratio becomes d/k richer than stoichiometric where d is the desired rich deviation and k is typically 4. The estimated cumulative NOx value in the lean NOx trap is then set to the appropriate value, the appropriate value being zero if the regeneration process is complete and non-zero if the regeneration process was interrupted. The stratified charge operating region is restored and engine 10 is returned to the requested operating mode (stratified or homogeneous), depending on the driver requested torque, and the subroutine exited at block 224 or block 234, depending on the regeneration ending event. The end of the regeneration can be detected based on a method similar to that described in commonly assigned U.S. Pat. No. 6,293,092. As indicated in subroutine 200, if the exhaust gases flowing out of the lean NOx trap 22 as monitored at block 220 do not indicate a sufficiently rich air-fuel ratio, the regeneration event continues with appropriate monitoring for other exit conditions described below.

The system includes means for monitoring the driver requested torque demand on the engine 10 and a determination is made in block 230 whether to continue or to end the regeneration event based on engine load. The regeneration event continues with the driver requested torque sufficiently high for the engine 10 to operate in the homogeneous charge region. If the driver requests a sufficiently low torque causing a transition into the stratified charge operating region, the regeneration event is ended in block 232. The remaining NOx stored in the lean NOx trap 22 is estimated and the normal or baseline selective engine operation (homogenous or stratified) is restored in block 234.

Also, the elapsed regeneration event time is monitored as indicated at block 228. If the total elapsed regeneration event time interval exceeds a target maximum regeneration time, then the regeneration event is ended and the subroutine is exited as shown in block 232 and 234. If the total elapsed regeneration event time interval does not exceed a target maximum regeneration time, then the regeneration event continues with monitoring as in block 220. The accumulated NOx value is reset to the stored NOx level contained within the lean NOx trap, which is zero assuming the regeneration event was complete as determined at block 220 and a non-zero value assuming the regeneration event was interrupted by load or time criteria as determined at blocks 230 and 228 respectively.

In a typical method of operating a SIDI engine in a lower range of engine output, the cylinders of the engine are operated in a stratified charge mode. In the stratified charge operating mode, fuel is injected into each engine cylinder on its piston compression stroke and is directed toward the spark plug where it is ignited near the end of the compression stroke to efficiently burn an overall lean mixture in the cylinder having an approximately stoichiometric or rich mixture at the point of ignition for immediate ignition and controlled combustion. At higher engine loads, the engine is operated in a homogenous charge mode operation region. In the homogeneous charge operating mode, fuel is injected into each cylinder on its respective intake stroke and the air-fuel mixture is subsequently compressed as a relatively homogenous air fuel mixture which is ignited by the spark plug near the end of the compression stroke or during the early expansion stroke in a conventional manner.

Figure 3B:
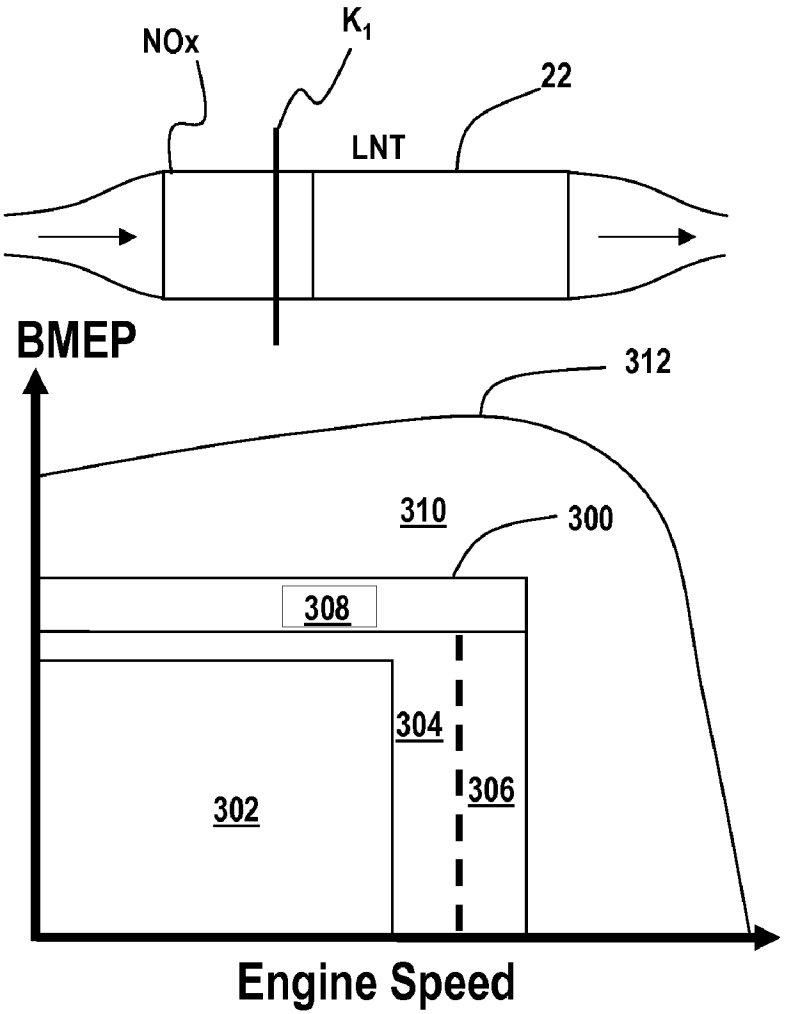
FIGS. 3A and 3B are diagrams illustrating the method of operating a SIDI engine in accordance with the present control strategy comprising shrinking the stratified charge operating region and enlarging the homogenous charge operating region in accordance with the flow of operations as shown in FIG. 2.
Figure 3A:
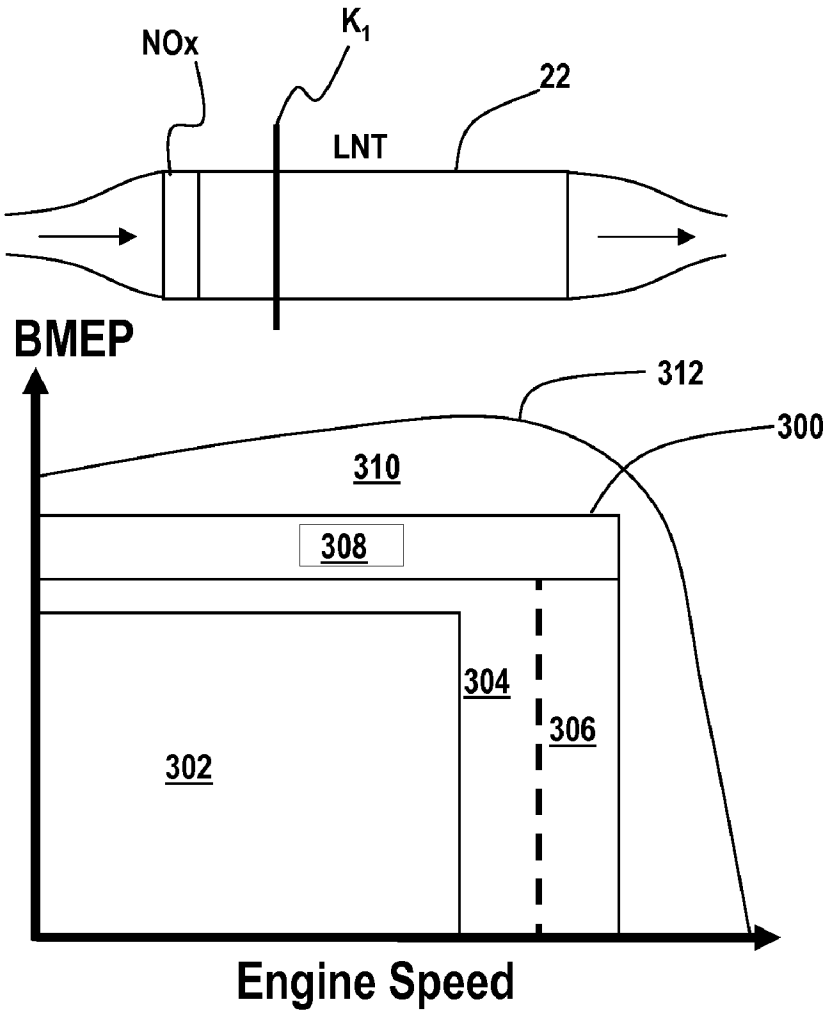

Referring to FIGS. 3A and 3B, the present method of operating a SIDI engine comprising shrinking the stratified region of operation and enlarging the homogenous charge region of operation in accordance with the flow of operations as shown in FIG. 2 is illustrated. The respective bottom portions of FIGS. 3A and 3B illustrate the break mean effective pressure (BMEP) over a range of engine speeds. The respective top portions of FIGS. 3A and 3B graphically represent different degrees of lean NOx trap loading of a lean NOx trap 22. Lean NOx trap 22 having an accumulated NOx loading (NOx) that is less than the first threshold value K1 is shown in FIG. 3A. FIG. 3B shows a lean NOx trap 22 having an accumulated NOx loading (NOx) that exceeds the first threshold value K1. The graphs positioned below the two lean NOx traps 22 illustrate engine operation and shrinking of the stratified charge operating region relative to the estimated NOx loading in accordance with the present control strategy.

In a lower range of engine output, the cylinders of the engine are operated in a stratified charge mode region encompassed by the line 300. The stratified charge region inside of line 300 includes stratified charge operating region 302 (transitioning from homogeneous), extended stratified charge operating region 304 (also transitioning from homogeneous), stratified charge operating region 306, and double pulsing region 308. During higher engine loads, the engine is operated in a homogenous charge mode operation region 310 encompassed between lines 312 and lines 300.

In FIGS. 3A and 3B, the lean NOx trap loading is shown as darkened area referred to as NOx and the arrows indicate exhaust flow through the lean NOx trap 22. In FIG. 3A, the lean NOx trap loading has not exceeded the first threshold value K1. The engine operation continues with the regions of homogenous and stratified charge operation as indicated in the graph of FIG. 3A. In FIG. 3B, the lean NOx trap loading has exceeded the first threshold value K1. As the accumulated NOx in the lean NOx trap exceeds the first threshold value K1, the regions of stratified charge operation is reduced, thereby enlarging the homogenous charge operating region. In this way, the occurrence of the next homogenous charge operating event is hastened. Assuming a driver-triggered transition to homogeneous charge engine operation does not occur until the NOx loading exceeds the second threshold value K2 or the LNT estimated temperature exceeds threshold temperature T1, homogenous charge mode operation of the engine is forced at the desired air-fuel ratio.

Figure 4:
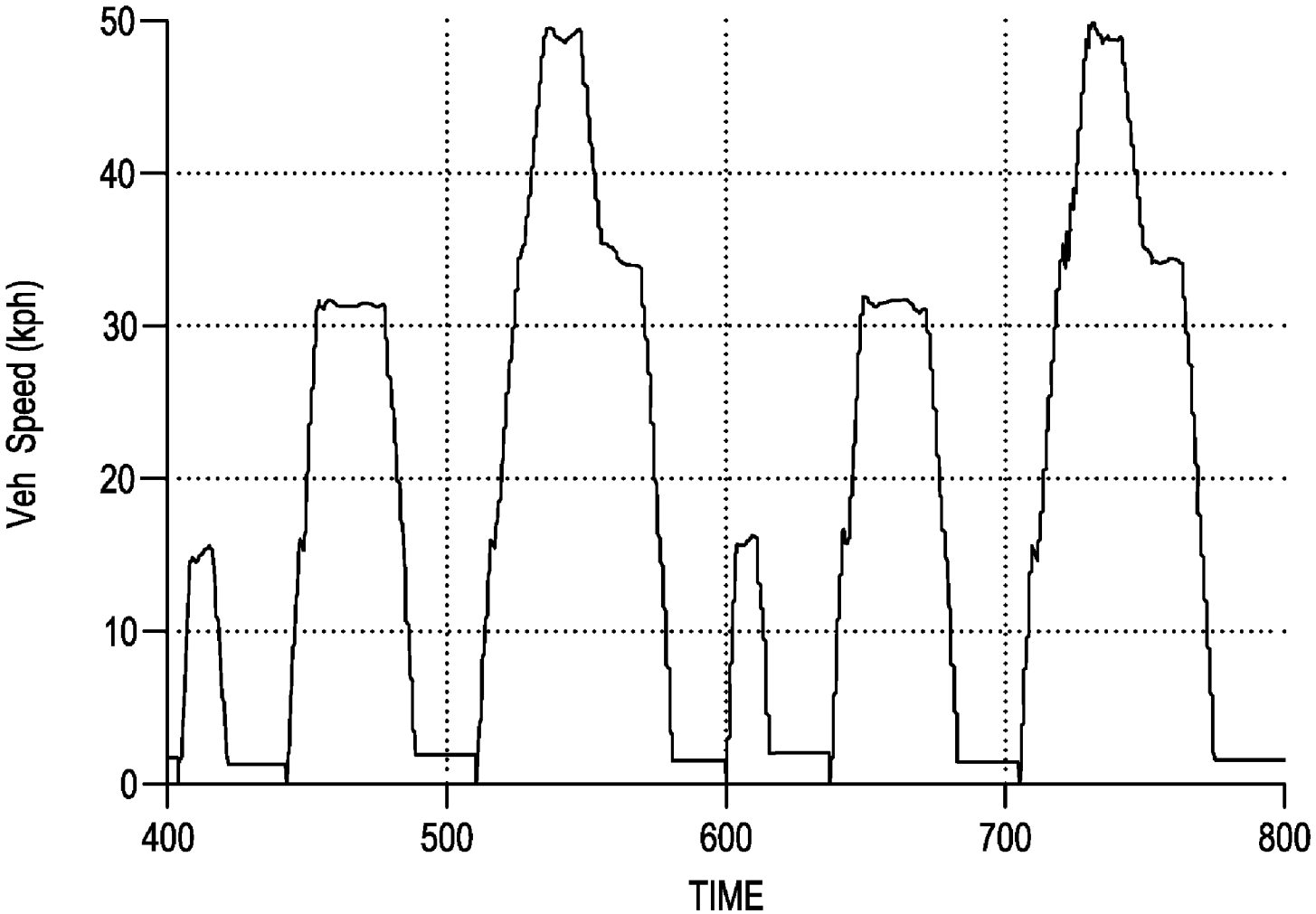

FIGS. 4-7 illustrate vehicle speed, cumulative NOx loading, desired equivalence ratio, and BMEP for lean NOx trap purging in accordance with the method described in FIG. 2. In FIG. 4, the vehicle speed is shown in an illustrative test.

Figure 5:
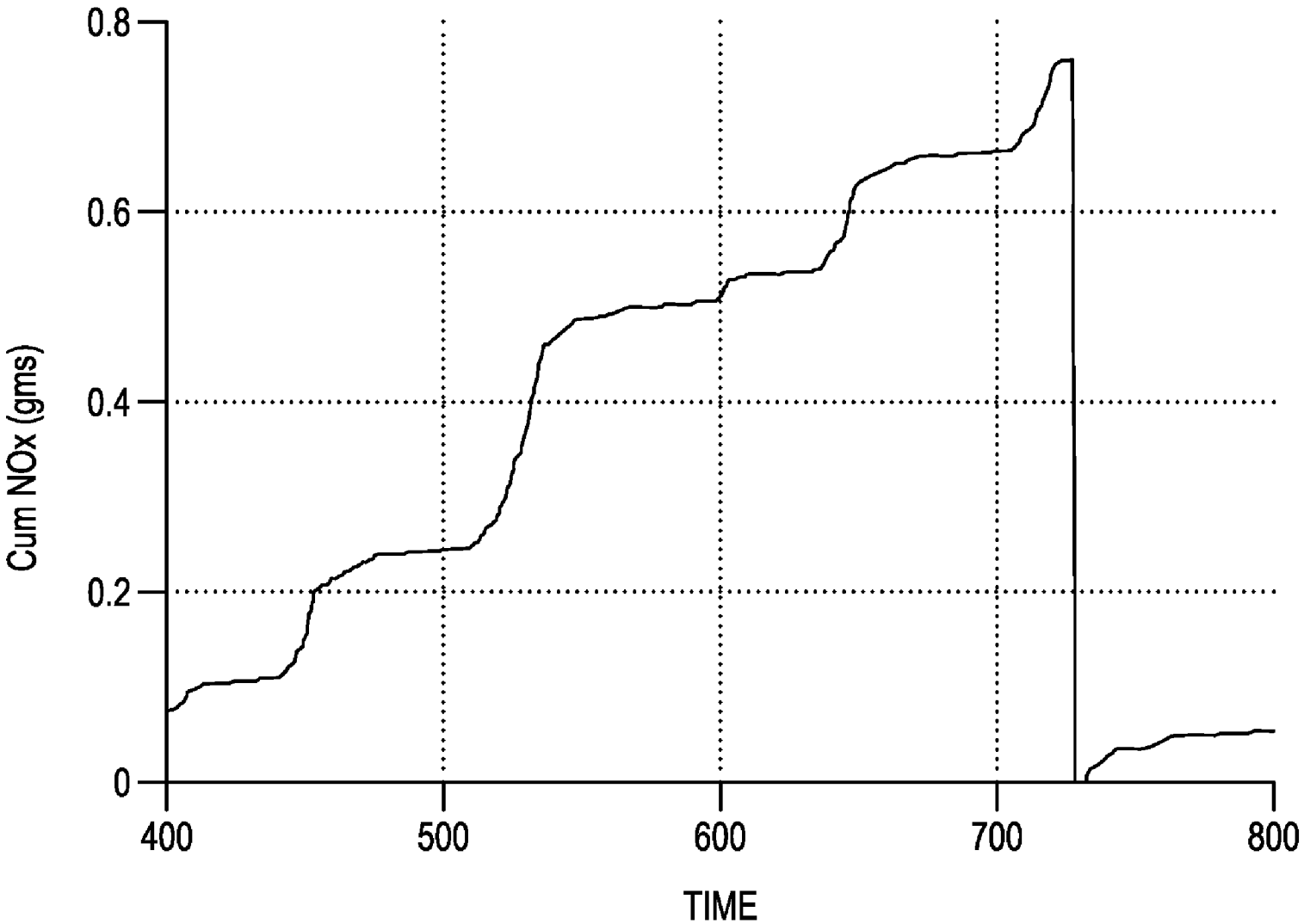

FIG. 5 is a graph illustrating the cumulative NOx loading and purging at a regeneration initiating event initiated by the driver causing transition to homogeneous operation where the homogeneous operating region was enlarged as per this disclosure upon the accumulated NOx exceeding K1.

Figure 6:
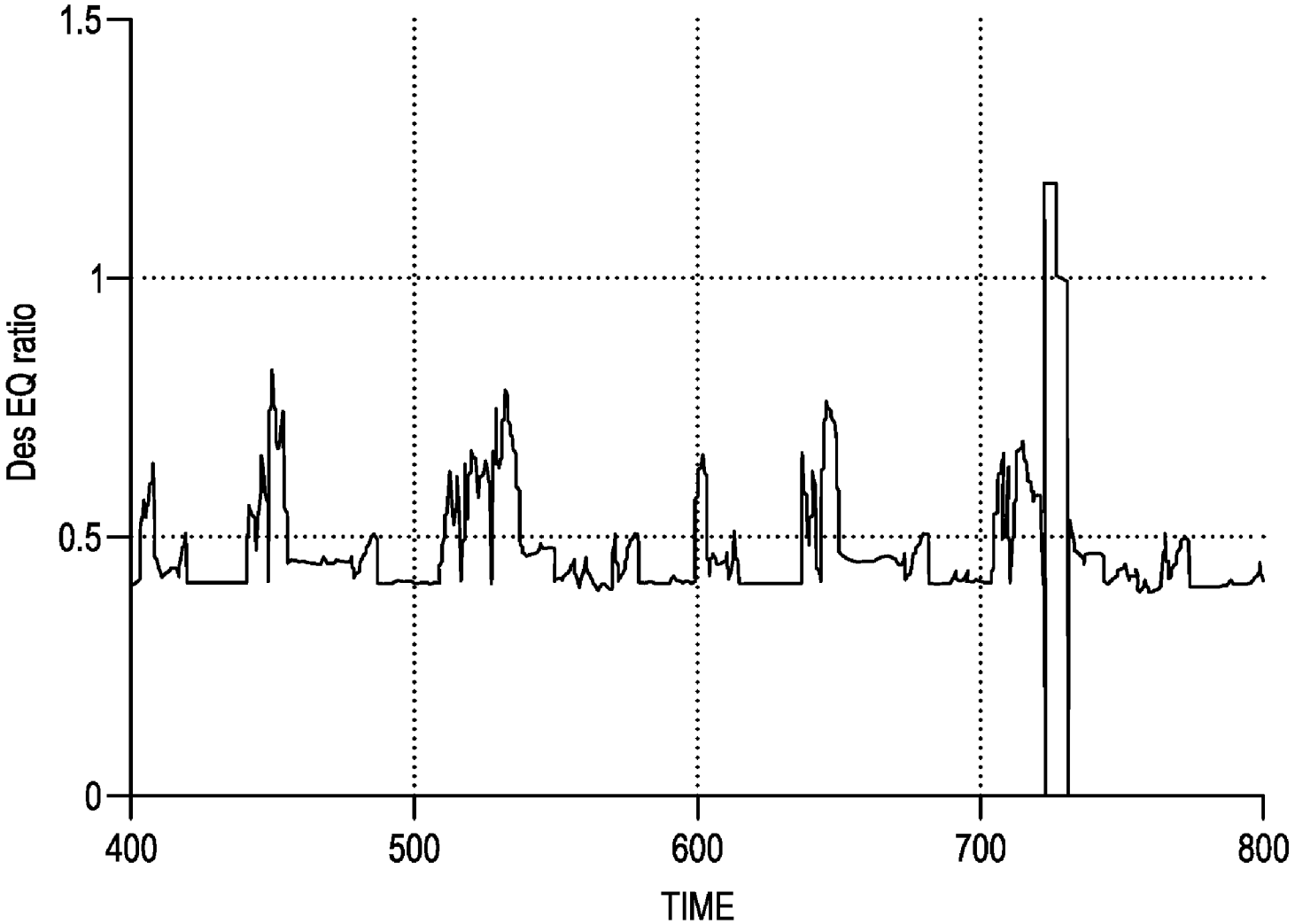
Figure 7:
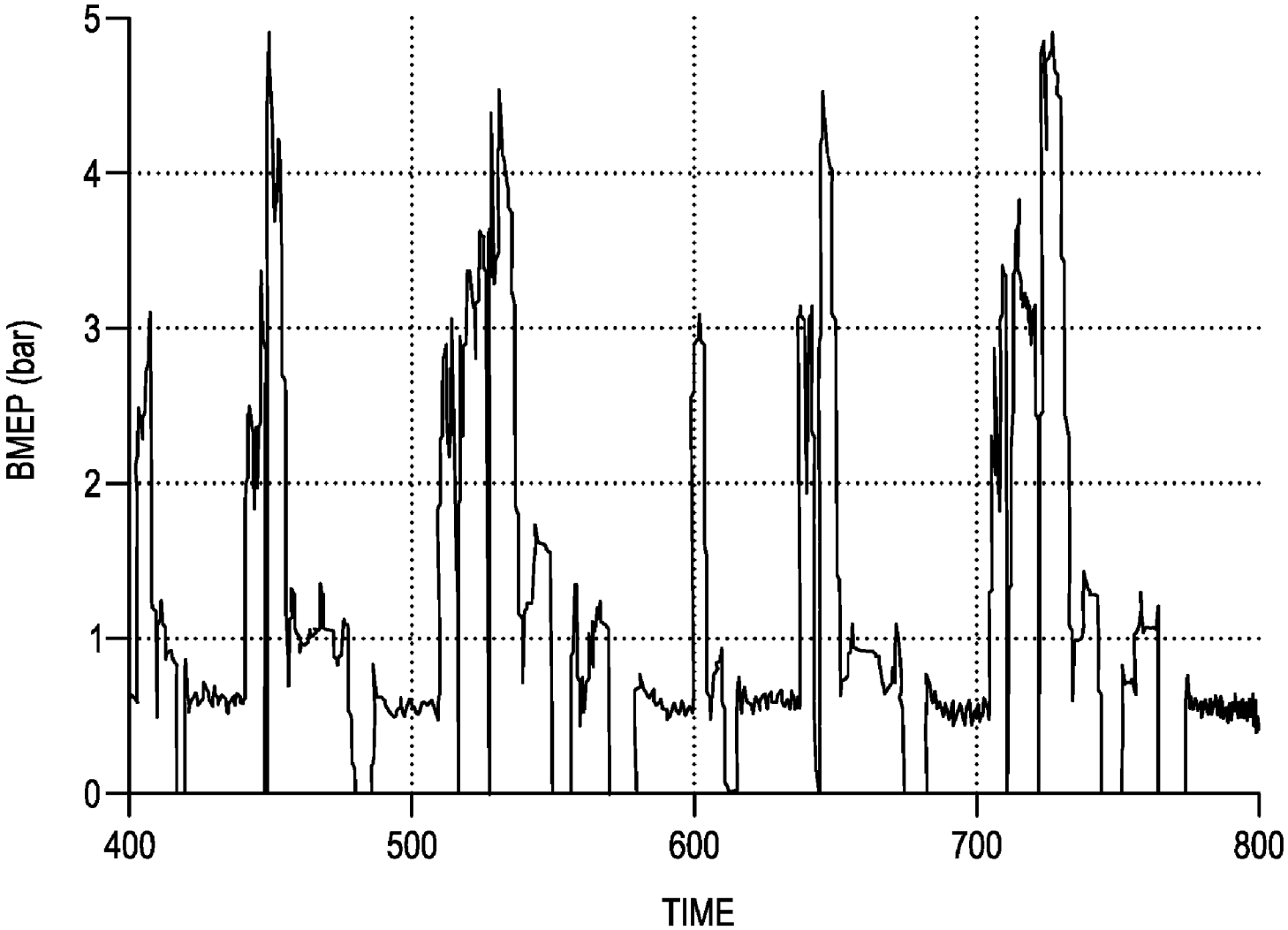

FIGS. 6 and 7 show a single regeneration event hastened in accordance with the disclosure due to the accumulated NOx exceeding K1. In FIG. 6, the desired fuel/air equivalence ratio (Des EQ ratio) for initiating a regeneration event is set in accordance with step 216 of FIG. 2. FIG. 7 illustrates transition to homogenous operation and return to stratified charge operation. FIGS. 6 and 7 illustrate that at an x axis value (time) of about 450, the BMEP approaches 5 bar. As the accumulated NOx as per FIG. 5 is still below the first threshold, the engine operates in stratified mode as shown in FIG. 6. However, as time progresses, the LNT fills up. Just after time 700, the accumulated NOx exceeds the first threshold as seen in FIG. 5. The active shrinkage of the stratified region then causes the engine to be forced to homogeneous operation the next time the BMEP approaches 5 bar, around time 720. This leads to an LNT regeneration event, as seen in FIG. 6 with the fuel-air equivalence ratio exceeding 1.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method for controlling regeneration of a NOx trap comprising:

estimating an accumulated NOx in a NOx trap located in the exhaust path of an engine;

defining a stratified engine operating region as the only region in which stratified charge combustion mode is enabled;

defining an area of low engine speed and engine load, wherein stratified charge combustion mode is highly preferred; and hastening regeneration of the NOx trap by iteratively redefining the stratified engine operating region in which stratified charge combustion mode is enabled, each iterative definition reducing the stratified engine operating region to a smaller area than the previous stratified engine operating region when the accumulated NOx exceeds a first threshold value; and initiating regeneration when engine speed and engine load do not fall within the stratified engine operating region.

2. The method of claim 1, further comprising:

estimating a temperature of the NOx trap; and determining a desired air-fuel ratio for initiating regeneration of the NOx trap, the desired air-fuel ratio being determined based upon one or a combination of the estimated accumulated NOx stored within the NOx trap and the temperature of the NOx trap.

3. The method of claim 1, further comprising:

ending regeneration and resetting the estimated accumulated NOx to a level of remaining stored NOx in the NOx trap when a regeneration ending event is reached.

4. The method of claim 3, further comprising:

monitoring exhaust gases flowing out of the NOx trap wherein the regeneration ending event is reached when the monitored exhaust gases flowing out of the NOx trap show a rich deviation.

5. The method of claim 3, further comprising:

monitoring an elapsed regeneration event time wherein the regeneration ending event is reached when the elapsed regeneration event time exceeds a target maximum regeneration event time interval.

6. The method of claim 3, further comprising:

monitoring driver torque demand on the engine wherein the regeneration ending event is reached when the driver torque demand drops below a threshold value.

7. The method of claim 3, wherein the regeneration ending event is triggered by a driver initiated action.

* * * * *